United States Patent [19]

Sandler

[11] Patent Number: 4,498,086

[45] Date of Patent: Feb. 5, 1985

[54] BROAD BAND LIQUID LOADED DIPOLE ANTENNA

[75] Inventor: Sheldon S. Sandler, Lexington, Mass.

[73] Assignee: Geo-Centers, Inc., Newton Upper Falls, Mass.

[21] Appl. No.: 465,623

[22] Filed: Feb. 10, 1983

[51] Int. Cl.[3] ..... H01Q 9/16

[52] U.S. Cl. ..... 343/807; 343/740; 343/873

[58] Field of Search ..... 343/739, 740, 807, 872, 343/873

[56] References Cited

U.S. PATENT DOCUMENTS 4,008,477 2/1977 Babij et al. ..... 343/873
4,246,586 1/1981 Henderson et al. ..... 343/873

FOREIGN PATENT DOCUMENTS 1552233 9/1979 United Kingdom ..... 343/873
2042808 9/1980 United Kingdom ..... 343/873

*Primary Examiner*—Eli Lieberman
*Attorney, Agent, or Firm*—Louis Orenbuch

[57] ABSTRACT

A broad band dipole antenna of short length is formed by two tubular linear radiators which are spaced apart at their adjacent inner ends. Each of the radiators is encased in an electrically insulative sleeve and the antenna is liquid loaded along its length by a jacket of conductive fluid disposed between the insulative sleeve and an insulative tubular housing surrounding the radiators. The dipole is center-fed and each of the radiators, at its outer end, terminates in a connection to one end of a lumped resistive load whose other end is connected to a conductive disk that is in contact with the conductive liquid.

2 Claims, 3 Drawing Figures

BROAD BAND LIQUID LOADED DIPOLE ANTENNA

FIELD OF THE INVENTION

This invention relates in general to antennas for the radiation of electromagnetic wave energy. More particularly, the invention pertains to an improved antenna for radiating electromagnetic wave energy into the ground and which can also be used for reception of echoes of that energy.

BACKGROUND OF THE INVENTION

It is well known that the properties of earth are such that low frequency electromagnetic waves penetrate farther into the earth than high frequency electromagnetic waves. Consequently, frequencies above 20MHz are of little interest for prospecting in the earth at great depths by the method of transmitting electromagnetic wave energy into the ground and detecting the wave energy reflected from impedance discontinuities in the ground. In such geophysical exploration it is necessary to have an antenna that can easily be moved over the ground to enable the area of interest to be surveyed. Because low frequency antennas tend to be physically large, reduction in size of the antenna is an important consideration for an antenna intended for actual field use. A conventional dipole antenna, as is well known, should be about one half wavelength long. Thus, a conventional dipole antenna for transmitting a 10MHz signal would be about 15 meters in length. Obviously, an antenna that is 15 meters long presents problems in transporting it in the field.

A time domain radar system used for subsurface exploration imposes more stringent requirements on its transmitting and receiving antennas then a narrow band radar system. Time domain radar systems for geophysical exploration require a wide band antenna with a bandwidth in the order of two or three octaves. For example a time domain radar system having a 10MHz center frequency requires its antenna to transmit signals in the band from about 5MHz to about 15MHz. An important consideration for such a broad band transmitting antenna is that the impulse energy travelling along the antenna be nearly completely absorbed when it reaches the outer ends of the antenna to prevent the wave energy from returning back along the antenna and radiating a second signal which masks the reflections of the first signal.

THE INVENTION

The invention resides in a broad band antenna of small size that provides improved coupling to the earth and, consequently, performs better for deep earth prospecting than any known antenna of substantially equal length. The invention is embodied in a center-fed linear dipole having lumped resistance loading at its outer ends. The linear radiator elements of the dipole, except at their outer ends, are encased in an insulating sleeve and the antenna is liquid loaded along its length by a jacket of conducting fluid that surrounds the linear radiator elements. For reasons of ready availability, the conducting fluid is usually salt water. Matching the impedance of the antenna to earth can be accomplished by using fluids with different dielectric constants. For example, cottonseed oil has been used over ice covered terrain. Liquid loading of the antenna causes the antenna to appear to be electrically longer than its physical length. Salt water for example, can cause the antenna to appear to be about three times longer than its physical length. Reflections of impulse wave energy reaching the outer ends of the antenna are minimized by the end load resistances.

THE DRAWINGS

The invention, both as to its arrangement and mode of operation, can be better understood from the detailed description of the preferred embodiment which follows when it is considered in conjunction with the accompanying drawing in which FIG. 1 is a view of the preferred embodiment of the invention with parts broken away to show its internal arrangement;

FIG. 2 is an enlarged view in cross-section of the adjacent inner ends of the linear dipole elements; and FIG. 3 is an enlarged view in cross-section of the arrangement at the outer end of a linear dipole element.

DETAILED DESCRIPTION OF PREFERRED EMBODIMENT

Figure 1:
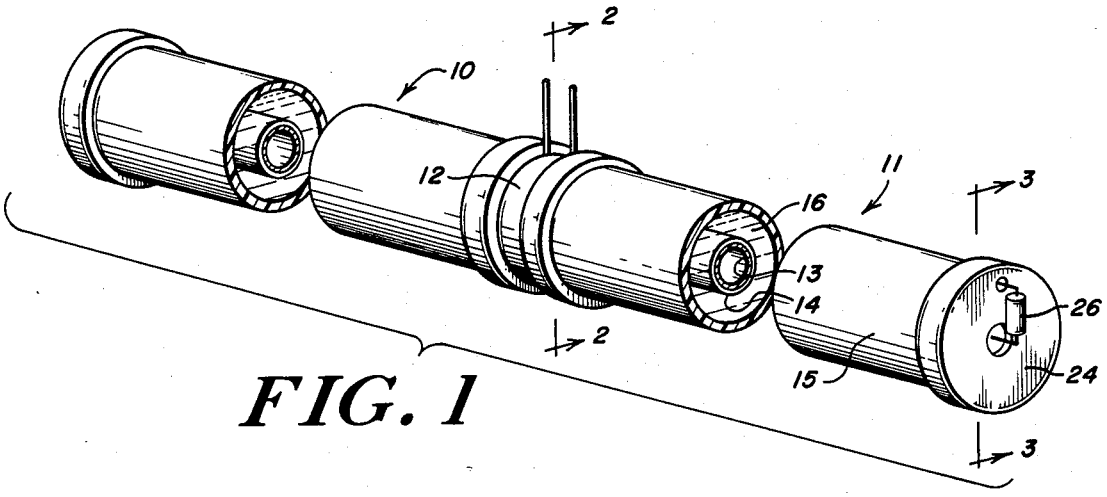

Referring now to the drawings, the invention is shown embodied in an antenna for a deep earth penetration time domain radar having a 10MHz center frequency and a bandwidth extending from approximately 5MHz to about 15MHz. The antenna depicted in FIG. 1 is a center-fed linear dipole having two elements 10 and 11 separated at their inner ends by an insulative spacer 12. Inasmuch as the two elements of the dipole are identical, except that one is the mirror image of the other, only one of those elements is herein described in detail.

Figure 2:
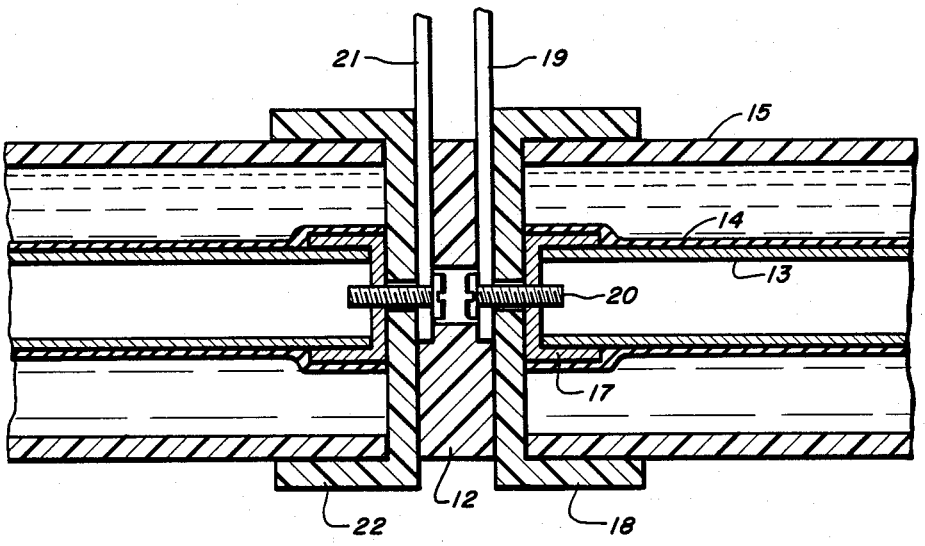
Figure 3:
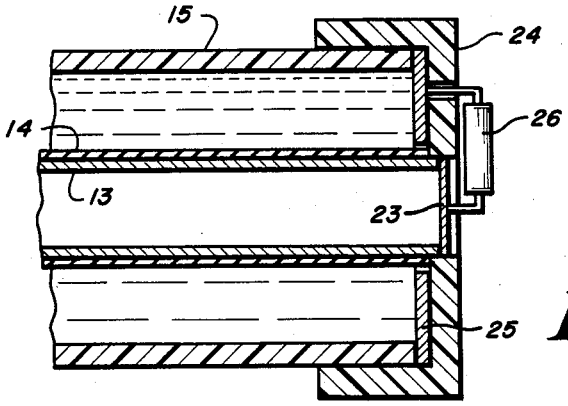

Each of the elements 10 and 11 is formed by a linear centrally extending radiator 13, 14 which can be a copper tube having an outside diameter of $\frac{3}{4}''$ and a length of about 5'. As best shown in FIGS. 2 and 3, the copper tube 13 is encased in an insulating sleeve 14 of an electrically insulative, liquid impervious material, such for example, as the heat shrinkable dielectric tubing that is now widely available in the electronics industry. Copper tube radiator 13 is disposed coaxially within a jacket 15 of electrically non-conductive material. A plastic tube having an inside diameter of 3" and an outside diameter of $3\frac{1}{2}''$ was found to be suitable in the preferred embodiment. The space between insulating sleeve 14 and jacket 15 is filled with an electrically conductive fluid 16, such as salt water.

Referring now to FIG. 2, the inner end of copper tube radiator 13 is closed by a conductive cup 17 over which the insulative sleeve forms a water tight seal. A non-conductive end cap 18, preferably of the same material as pipe 15, closes off the inner end of jacket 15 to contain the liquid inside the jacket. Electrical connection is made to the radiator 13 through a lead-in conductor 19 that has a metal screw 20 extending through insulative end cap 18 into engagement with the conductive cup 17.

As can be seen from FIG. 2, the other element of the dipole similarly has a lead-in conductor 21. The two liquid loaded elements of the dipole are separated by the insulative spacer 12 disposed between the end caps 18 and 22.

Referring now to FIG. 3 which is an enlarged view of the outer end of element 10, the copper tube radiator 13 is closed off by a copper disk 23. An insulative end cap 24 seals the jacket 15 against leakage of the liquid which loads the antenna. Inside end cap 24 is a copper disk 25 which has a central opening into which extends the tube 13 and its insulative sleeve 14. An electrical connection between disk 23 and disk 25 is made by a resistor 26 whose value is chosen to cause the wave energy reaching the end of the antenna to be absorbed so that no significant amount of wave energy returns down the radiator 13.

It should be noted that the conductive liquid in the jacket is in electrical contact with copper disk 25 and consequently that liquid acts to absorb wave energy passing into it through resistor 26.

It can be appreciated that each of the radiators of the dipole is surrounded by a jacket of an electrical conductive fluid which makes the antenna appear electrically longer than its physical length. Thus, although the preferred embodiment here described has a center frequency of 10MHz, the antenna is only 10 feet long.

What is claimed is:

1. A broad band dipole antenna comprising (a) a pair of elongate electrically conductive elements having adjacently disposed inner ends, (b) an insulative sleeve disposed over and substantially coextensive with each of the elongate elements, (c) an electrically non-conductive jacket disposed around and substantial coextensive with each of the elongate elements, (d) an electrically conductive liquid filling the space between the insulative sleeve and the jacket, (e) an electrically conductive member disposed adjacent the outer end of each elongate element, the electrically conductive member being insulated from the elongate element and in electrical contact with the conductive fluid, (f) electrically resistive means connected between the outer end of the elongate element and the electrically conductive member and, (g) means providing external electrical connections to the inner ends of the elongate elements.

2. A broad band dipole antenna for geophysical exploration comprising (a) a pair of elongate radiators for radiating electromagnetic energy, the elongate radiators having adjacently disposed inner ends, (b) an insulative sleeve disposed over and substantially coextensive with each of the elongate radiators, (c) an electrically non-conductive jacket disposed around, and substantially coextensive with each of the elongate radiators, (d) an electrically conductive liquid filling the space between the insulative sleeve and the jacket, the dielectric constant of the conductive liquid affecting the impedance match of the antenna to the ground, (e) an electrically conductive member disposed adjacent the outer end of each elongate radiator, the electrically conductive member being insulated from the radiator and in contact with the conductive fluid, (f) electrically resistive means connecting the outer end of the elongate radiator and the electrically conductive member, and (g) means providing external electrical connections to the inner ends of the elongate radiators.

* * * * *